US007819125B2

(12) United States Patent
Maelstaf

(10) Patent No.: US 7,819,125 B2
(45) Date of Patent: Oct. 26, 2010

(54) CASE FOR PACKAGING A PRODUCT

(75) Inventor: Luc Maelstaf, Courbevoie (FR)

(73) Assignee: L'Oreal, Paris (FR)

( * ) Notice: Subject to any disclaimer, the term of this patent is extended or adjusted under 35 U.S.C. 154(b) by 2259 days.

(21) Appl. No.: 10/397,184

(22) Filed: Mar. 27, 2003

(65) Prior Publication Data

US 2003/0217761 A1 Nov. 27, 2003

Related U.S. Application Data

(60) Provisional application No. 60/372,434, filed on Apr. 16, 2002.

(30) Foreign Application Priority Data

Mar. 28, 2002 (FR) ..... 02 03927

(51) Int. Cl.

| | |
|---|---|
| ***A45D 33/00*** | (2006.01) |
| ***A45D 33/24*** | (2006.01) |
| ***A45D 33/22*** | (2006.01) |
| ***A45D 33/26*** | (2006.01) |

(52) U.S. Cl. ..... 132/293; 132/294; 132/295

(58) Field of Classification Search ..... 132/293–297, 132/300, 305

See application file for complete search history.

(56) References Cited

U.S. PATENT DOCUMENTS

| | | | | |
|---|---|---|---|---|
| 1,460,950 | A | 7/1950 | Denney | |
| 3,161,315 | A | 12/1964 | Braun | |
| 3,392,868 | A | 7/1968 | Pfrommer | |
| 3,476,123 | A | 11/1969 | Flax | |
| 4,807,773 | A | 2/1989 | Tsai | |
| 5,836,319 | A | 11/1998 | Lombardi | |
| 6,186,349 | B1 | 2/2001 | Tempongko | |
| D442,338 | S * | 5/2001 | Roman | D28/82 |
| 6,378,533 | B1 | 4/2002 | Roman | |

FOREIGN PATENT DOCUMENTS

| | | |
|---|---|---|
| JP | S60-002909 | 1/1985 |
| JP | S60-4238 | 1/1985 |
| JP | 2000-83724 | 3/2000 |

* cited by examiner

*Primary Examiner*—Robyn Doan
(74) *Attorney, Agent, or Firm*—Finnegan, Henderson, Farabow, Garrett & Dunner, LLP

(57) ABSTRACT

A case for packaging a product may include a first portion defining a housing and an opening permitting access to the housing. The opening may face in a first direction. The case may include a second portion pivotally coupled to the first portion via a pivot member so as to permit pivoting of the second portion with respect to the first portion about a pivot axis substantially parallel to said first direction. The second portion may be pivotally movable with respect to the first portion between a closed position covering the opening and an open position.

58 Claims, 4 Drawing Sheets

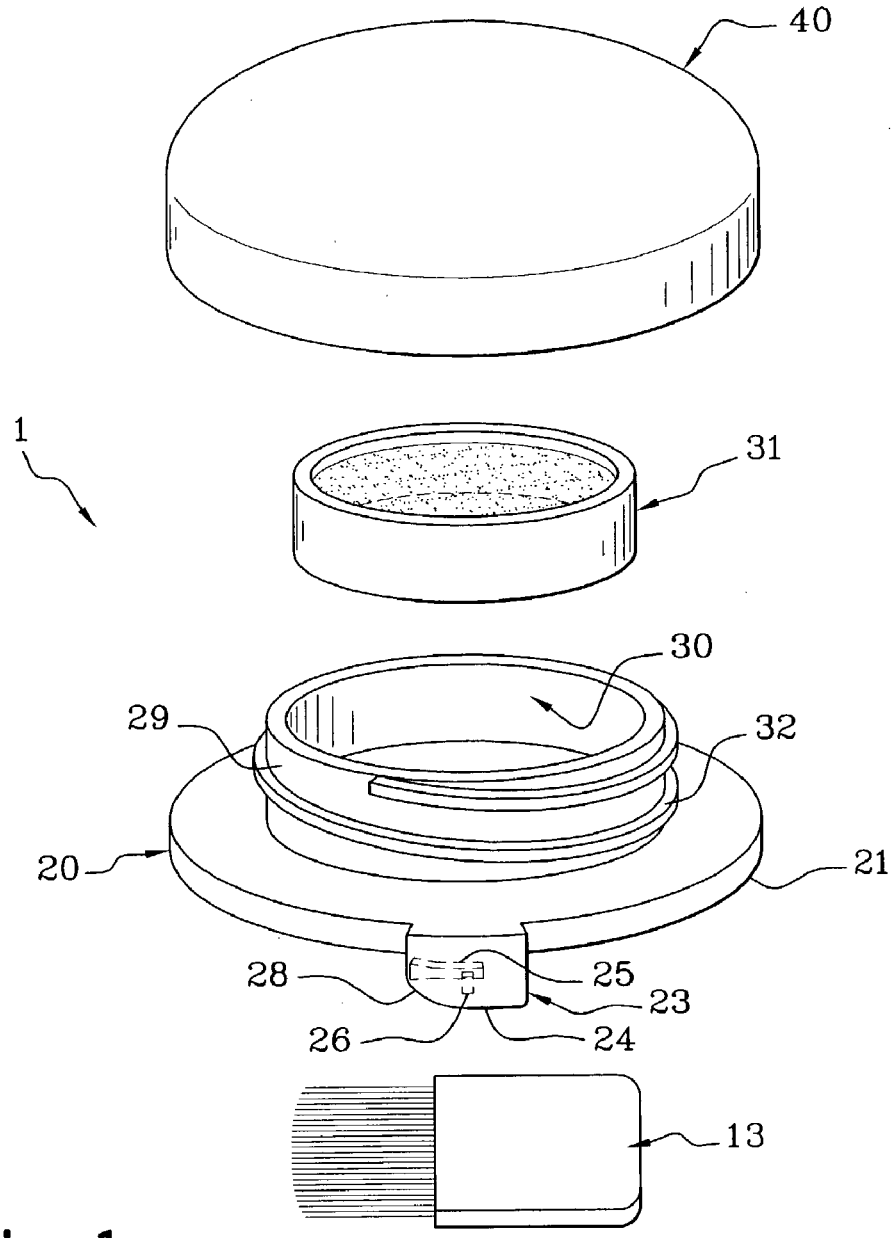
Fig. 1
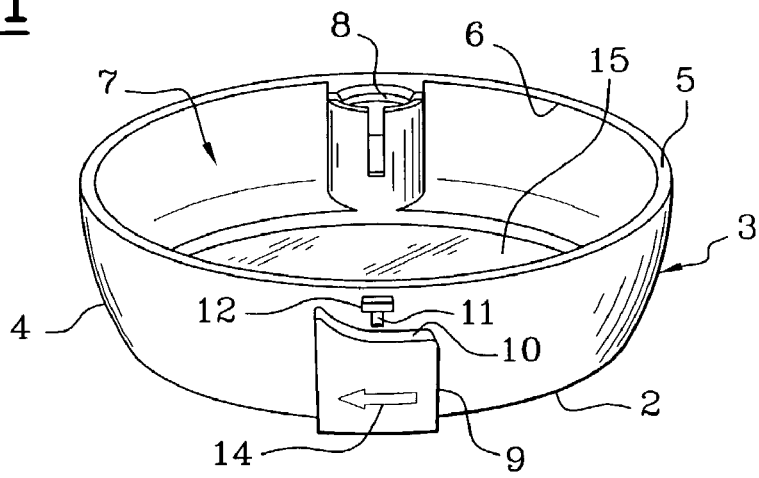

CASE FOR PACKAGING A PRODUCT

This application claims benefit of priority under 35 U.S.C. §119(e) of U.S. Provisional Application No. 60/372,434, filed Apr. 16, 2002.

The present invention relates to a case for packaging a product, for example, a cosmetic product (e.g., a make-up product).

DESCRIPTION OF THE RELATED ART

Some cases for packaging cosmetic products may include a lid articulated to a bottom that defines a housing and an opening roughly situated in a plane. Generally, the lid may be articulated about an axis parallel to the plane of the opening via a connecting element. Such cases may also include a sophisticated mechanism for opening and closing of the lid with respect to the bottom. A sophisticated opening/closing mechanism generally provides a good quality of closure between the lid and the bottom and allows a greater number of repeated opening and closing movements without significant wear of the mechanism or the articulation.

These cases with such sophisticated opening/closing mechanisms are, however, very expensive to produce. Therefore, these cases are reserved primarily for special distribution channels.

Of course, there are some cases utilizing less sophisticated systems of articulation and opening/closing mechanism. While such cases may be more economic to produce, their useful life may be relatively shorter than those utilizing highly sophisticated systems.

A box or case with a hinge having a rotating axis perpendicular to the opening plane of the housing is also known. For example, U.S. Pat. No. 6,186,349 discloses a case having a pivoting axis located at the center of a housing delimited by the cooperation of two semi-cylindrical shells.

U.S. Pat. No. 3,476,123 discloses a case having a number of circular trays which can pivotally move in relation to one another about an axis perpendicular to the face of the trays. These circular trays are linked two by two with a single snap fastening mechanism. The long life of such a system requires a robust articulation mechanism.

Moreover, in order to allow a user to open the case only in the prescribed manner, it was necessary to have a snap fastening nib (as well as a corresponding socket) having a relatively significant height to prevent the user from opening the case in an non-prescribed manner. Unfortunately, this type of opening/closing mechanism imposes a limited applicability because the various circular trays can only be moved according to a prescribed movement for opening and closing.

U.S. Pat. No. 3,392,868 discloses a cosmetic container having an elongated hollow body defined by spaced end members that are connected by an integral side-wall portion. The container has one or more trays received within the hollow body and pivotally mounted about an axis perpendicular to the face of the trays. Any relative movement other than the pivotal movement about the pivoting axis is prevented by the presence of two fixedly spaced end members arranged at each end of the container.

U.S. Pat. No. 3,161,315 discloses a case having a complicated opening/closing mechanism, which causes a substantial increase in the manufacturing cost.

Therefore, there exists a need for a case for packaging a product (e.g., a cosmetic product), that is economic to produce, and simple to use, with satisfactorily long life.

Although the present invention may obviate one or more of the above-mentioned needs, it should be understood that some aspects of the invention might not necessarily obviate one or more of those needs.

SUMMARY

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a case for packaging a product. The case may include a first portion defining a housing and an opening permitting access to the housing. The opening may face in a first direction. The case may include a second portion pivotally coupled to the first portion via a pivot member so as to permit pivoting of the second portion with respect to the first portion about a pivot axis substantially parallel to said first direction. The second portion may be pivotally movable with respect to the first portion between a closed position covering the opening and an open position.

In another aspect, the opening may have a substantially circular cross-section.

According to another aspect, a case for packaging a product may include an opening/closing mechanism. The opening/closing mechanism may include a guidance arrangement configured so as to allow substantially only the pivotal movement of the second portion with respect to the first portion. The guidance arrangement may be distinct from the pivot member. The opening/closing mechanism may also include a locking arrangement configured to reversibly lock the pivotal movement of the second portion with respect to the first portion in the closed position.

The two arrangements of the opening/closing mechanism may serve two distinct functions. For example, the guidance arrangement may make it difficult for a user (without damaging the case irreversibly) to cause any opening movement of the second portion with respect to the first portion in a direction other than a prescribed pivoting direction that is perpendicular to the pivoting axis. The locking arrangement may reversibly lock the pivoting movement of the second portion with respect to the first portion in a closed position, which enables easy changeover between open and closed positions.

According to still another aspect, at least part of the guidance arrangement may be located on an outer lateral surface of the first portion.

According to yet another aspect, the guidance arrangement lacks a semi-cylindrical chamber receiving part of the first portion. An exemplary semi-cylindrical chamber receiving part of another case portion is shown in U.S. Pat. No. 6,378,533.

In another aspect, the opening/closing mechanism may include at least one guidance protrusion associated with one of the first portion and the second portion, and at least one guidance groove associated with the other of the first portion and the second portion. The at least one guidance protrusion may be configured to engage inside the at least one guidance groove so as to allow substantially only the pivotal movement of the second portion with respect to the first portion.

The term "groove" is used in a broad sense, and refers to, but is not limited to, a relatively long, narrow, shallow depression, slit, and/or opening. As mentioned above, U.S. Pat. No.

6,378,533 discloses a semi-cylindrical chamber. That semi-cylindrical chamber is not configured in the form of a groove.

The at least one guidance protrusion may have a sufficient height and the at least one guidance groove may have a corresponding, sufficient depth, so that when the at least one guidance protrusion is engaged inside the at least one guidance groove, the opening/closing mechanism substantially prevents a user from opening the case by a movement other than the pivotal movement about the pivoting axis, unless the user applies an excessive force and damages the case to an unusable condition. In an exemplary embodiment, the depth of the at least one guidance protrusion may be approximately 0.7 mm, and the height of the at least one guidance protrusion may be approximately 0.6 mm.

In some embodiments, unless there is a damage caused to one or more components of the case, the case may only be unlocked by the pivotally movement of the second portion with respect to the first portion about the pivot axis perpendicular to the face of the opening.

In still another aspect, the at least one guidance groove may extend substantially perpendicular to the pivot axis.

In yet another aspect, the at least one guidance groove may be defined by two edges deviating from one another in the direction substantially parallel to the pivot axis. By this exemplary configuration, if a user attempts to unlock the case by a movement perpendicular to the pivoting direction, one of the edges of the at least one guidance groove may contact the at least one guidance protrusion so as to prevent the movement attempted by the user.

According to another aspect, the at least one guidance groove may have a mouth portion for receiving the at least one guidance protrusion. The mouth portion may have a gradually widening width facing the at least one guidance protrusion so as to facilitate engagement between the at least one guidance protrusion and the at least one guidance groove. In an exemplary embodiment, the two deviating edges may be parallel to each other at a portion other than the mouth portion.

In still another aspect, an end of the at least one guidance groove, opposite from the mouth portion, may be closed so as to limit the pivotal movement beyond a prescribed condition. Alternatively, the end of the at least one guidance groove, opposite from the mouth portion, may be open so as to enable opening and closing of the case by the pivotal movement in both directions.

In yet another aspect, the at least one guidance groove may include two guidance grooves in order to close the case in both pivotal directions, but to open the case in only one pivotal direction. The two guidance grooves may extend in parallel to the face of the opening. One of the two guidance grooves may have an open end facing one pivotal direction, while the other of the two guidance grooves may have an open end facing the other pivotal direction. Optionally, the two guidance grooves may be separated by a common bottom.

According to still another aspect, the at least one guidance protrusion may be a flange elongated in the direction substantially perpendicular to the pivoting axis.

According to another aspect, the opening/closing mechanism may include a first part extending from the first portion and having a first guiding surface, and a second part extending from the second portion and having a second guiding surface. Optionally, the first guiding surface and the second guiding surface may be configured to engage with each other in the closed position, such that when the first portion and the second portion are in the closed position, the opening/closing mechanism may allow the pivotal movement of the second portion only in one pivotal direction with respect to the first portion for unlocking the first portion and the second portion from the closed position.

According to still another aspect, part of the first guiding surface may be substantially non-perpendicular to the pivot axis and part of the first guiding surface may be substantially perpendicular to the pivot axis. Optionally, part of the second guiding surface may be substantially non-perpendicular to the pivot axis and part of the second guiding surface being substantially perpendicular to the pivot axis.

According to yet another aspect, at least one of the first part and the second part may be integrally formed with a respective one of the first and second portions. For example, at least one of the first portion and the second portion may define the respective one of the first and second guiding surfaces. In an exemplary embodiment, the first part may be a side projection extending beyond the bottom of the first portion to engage the second part. Optionally, a surface of this side projection defines one of the guidance protrusion and the guidance groove of the opening/closing mechanism.

In a further aspect, at least one of the first part and the second part may be a plate member extending from a side wall of a respective one of the first and second portions. Optionally, a side edge of the plate member may define a respective one of the first and second guiding surfaces.

In a still further aspect, at least one of the first part and the second part may be formed on an outer surface of a side wall of a respective one of the first and second portions.

In another aspect, the opening/closing mechanism may include at least one indicator (e.g., in the form of an arrow) indicating a prescribed pivoting direction for opening and/or closing. In an embodiment, the first part may include a first arrow in a first pivotal direction, and the second part may include a second arrow in a second pivotal direction opposite to the first direction.

In still another aspect, the second guiding surface may have a profile that is complementary to the profile of the first guiding surface, such that the second guiding surface may tightly butt against the first guiding surface when the case is in the closed position.

In a further aspect, the case may include a product contained in the case. The product may be a cosmetic product.

In yet another aspect, the case may have at least one substantially circular outer cross-section and the pivot axis may be substantially perpendicular to said cross-section.

According to another aspect, the second portion may include a bottom. The bottom may be configured to close substantially the entire opening of the first portion.

According to yet another aspect, the second portion may include a bottom. The opening may be defined by an edge of the first portion and all of the edge may be below the bottom. In U.S. Pat. No. 1,460,950, only approximately half of the edge is located below the bottom of an intermediate element. With that configuration disclosed in U.S. Pat. No. 1,460,950, the useful volume of the compartment defined by the bottom is necessarily limited to the height of the lowest edge portion.

In another aspect, the opening/closing mechanism may be defined by a combination of the first and second portions.

In still another aspect, the guidance arrangement may include a first guidance member on a side wall of the first portion, and a second guidance member associated with the second portion. The first guidance member and the second guidance member may be configured to cooperate with each other so as to guide pivoting of the second portion with respect to the first portion.

According to another aspect, the locking arrangement may include a snap-fastening mechanism.

According to yet another aspect, the locking arrangement may include a locking groove associated with one of the first portion and the second portion, and a locking protrusion associated with the other of the first portion and the second portion. The locking protrusion may be configured to engage with the locking groove so as to reversibly lock the pivotal movement of the second portion with respect to the first portion in the closed position. In an exemplary embodiment, the locking protrusion and the locking groove engage by a snap-fastening mechanism.

In another aspect, at least a portion of the locking protrusion may have a curved outer surface profile in a plane substantially parallel to the pivot axis, so as to enable reversible locking of the pivotal movement. In an exemplary embodiment, the locking protrusion may be in the form of a "grain of rice" and the corresponding locking groove may have a relatively shallow depth, so as to allow easy opening and closing. Optionally, the height of the "grain of rice" may be approximately 0.3 mm.

In still another aspect, the locking protrusion may be configured to substantially prevent movement between the first portion and the second portion in a direction substantially parallel to the pivot axis when the locking protrusion is engaged with the locking groove in the closed position.

According to another aspect, the locking groove extends in a direction substantially parallel to the pivot axis.

According to yet another aspect, the locking protrusion may include a flange extending in the direction substantially parallel to the pivot axis and configured to lockingly engage with the locking groove.

In still another aspect, the opening/closing mechanism may be configured to allow the pivotal movement of the second portion in a first pivotal direction with respect to the first portion so as to reversibly lock the first portion with respect to the second portion in the closed position. Optionally, the opening/closing mechanism may be configured so that, when the first portion and the second portion are in the closed position, the pivotal movement may be allowed only in a second pivotal direction substantially opposite to the first pivotal direction for unlocking the first portion and the second portion from the closed position.

According to another aspect, the pivot member may include a pin associated with one of the first portion and the second portion, and a bore defined by the other of the first portion and the second portion. The pin may optionally be configured to be rotatably engaged in the bore.

According to yet another aspect, the pin may be snap-fastened within the bore. The pin may optionally be made from metal.

In another aspect, the housing defined by the first portion may be a first housing, and the second portion may define a second housing. In an embodiment, the second housing may be defined by a short annular skirt formed on the bottom of the second portion.

In still another aspect, the case may include a closure member configured to substantially close the second housing. Optionally, the closure member may be configured to substantially close the second housing via screw-fastening. In an exemplary embodiment, the screw-fastening of the closure member may be configured such that opening of the second housing is accomplished via rotation of the closure member with respect to the second portion in the direction opposite to that to open the first housing. Alternatively, the rotational direction of the closure member with respect to the second portion may be the same as that to open the first housing.

According to another aspect, the second housing may be defined by an annular skirt extending from a bottom of the second portion. Optionally, the bottom may be configured to cover at least a portion of the first housing.

According to still another aspect, an outer surface of the annular skirt may include a threaded portion configured to engage with a threaded portion of the closure member.

In another aspect, the first portion, the second portion, and the closure member may be configured to allow access to the first housing without placing the closure member in a position permitting access to the second housing. For example, the case may be configured in such a way as to allow access to the first housing before the closure member is removed to uncover the second housing. In the case of U.S. Pat. No. 1,460,950, access to a housing area is only possible after a lid has been removed. Additionally (or alternatively), the first portion, the second portion, and the closure member may be configured to allow access to the second housing without the case being in the open position.

In still another aspect, the case may include a product at least partially contained in at least one of the first housing and the second housing. The product may be poured or compacted directly into at least one of the first and second housings, or made available in the form of a cup that can be removably received or fixed in the at least one of the first and second housings.

In still yet another aspect, the product may be a make-up product comprising one of a blush, an eye shadow, and a rouge.

In still yet another aspect, at least a portion of the closure member is transparent or translucent. This characteristic may allow a user to see the appearance (e.g., color) of the product (e.g., make-up product) through the closure member.

According to another aspect, the case may include an applicator at least partially contained in at least one of the first housing and the second housing. The applicator may optionally be configured for application of the product (e.g., a pencil, brush, block of foam, felt, etc.).

In another aspect, the case may include a mirror. In an exemplary embodiment, the mirror may be arranged on a bottom surface of one of the first and second housings. Optionally, such a mirror may be attached with a suitable adhesive material.

In still another aspect, at least a portion of the case may be formed of a material comprising at least one of polypropylene, polystyrene acrylonitrile (SAN), and acrylobutadiene styrene (ABS). Other thermoplastic materials may also be used.

In yet another aspect, at least a portion of the case may be formed by molding the material.

According to another aspect, the first direction may be substantially parallel to the pivot axis.

According to yet another aspect, a case for packaging a product may only include a bottom and a closure member pivotally coupled to the bottom. The bottom may define a first housing for the product and a second housing for an applicator configured to apply the product. Alternatively, the applicator may have at least a portion configured in the form of a small tuft (e.g., a small tuft of bristles) and be arranged in the same housing with the product on top of its surface. Alternatively, the case may not include an applicator. For example, the product may be the type that is not normally applied with a particular applicator, such as a product sometimes applied with a finger. In other examples, an applicator could be separate from the case.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate exemplary embodiments of the invention and, together with the description, serve to explain some principles of the invention. In the drawings, FIG. 1 is an exploded view of an embodiment of a case for packaging a product, showing elements of the case before assembly;

DESCRIPTION OF EXEMPLARY EMBODIMENTS

Figure 2:
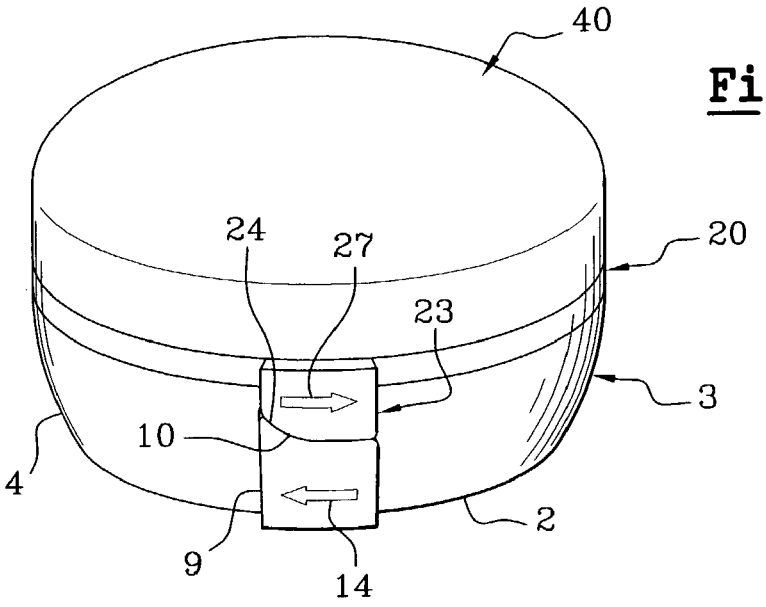
FIG. 2 is a perspective view of the case of FIG. 1 in a closed position.

Reference will now be made in detail to some possible embodiments of the invention, examples of which are illustrated in the accompanying drawings. Wherever possible, the same reference numbers are used in the drawings and the description to refer to the same or like parts.

FIGS. 1, 2, 3A, 3B, 4, 5A and 5B depict an exemplary embodiment of a case 1 that comprises a first portion 3 (e.g., a cup) and a second portion 20. A side wall 4 of the first portion 3 defines a housing 7 and includes a free edge 5 delimiting an opening 6 for the housing 7. The first portion 3 forms substantially circular external and/or internal cross-sections. The first portion 3 may be obtained by molding a material including 80% SAN and 20% ABS.

In the vicinity of its side wall 4, the first portion 3 comprises a bore 8 intended to receive a pin 22 of the second portion 20 by, e.g., snap-fastening. The bore 8 and the pin 22 are configured to permit pivoting of the second portion 20 with respect to the first portion 3. The bore 8 and the pin 22 have a pivoting axis X that is parallel to the direction that the opening 6 of the first portion 3 faces, so as to enable pivotal movement of the second portion 20 with respect to the first portion 3 about the axis X. In this embodiment, the opening 6 faces in an upward direction (with respect to the case orientation shown in FIG. 5A). The direction that the opening "faces" generally refers to a direction that is opposite to a line of sight for an observer to view an entire outline of the edges(s) defining the opening. For example, when an observer views the opening 6 in a downward direction (opposite to the direction that the opening 6 faces) from a vantage point above the opening 6, the observer is capable of seeing an entire outline of the edge defining the opening 6.

The opening 6 extends substantially entirely in a plane and the pivoting axis X is substantially perpendicular to that plane. Although the embodiment shown in the drawings has a substantially planar opening 6, it should be understood that alternative embodiments could be configured with an opening that is not substantially planar. In addition, the opening could be configured to face in more than one direction.

Figure 3B:
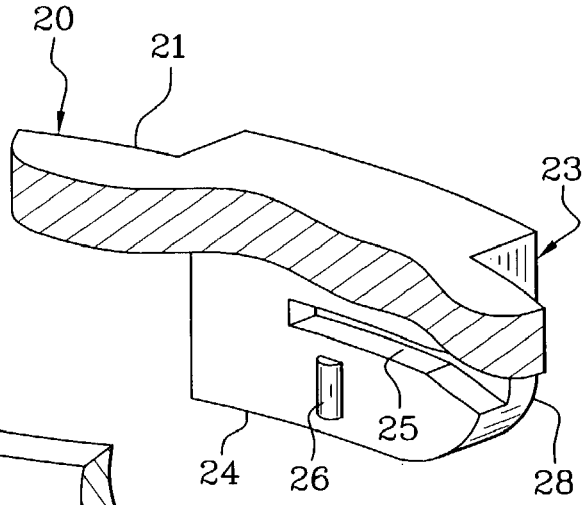
FIGS. 3A and 3B are partial schematic views of an opening/closing mechanism of the case of FIG. 1.
Figure 3A:
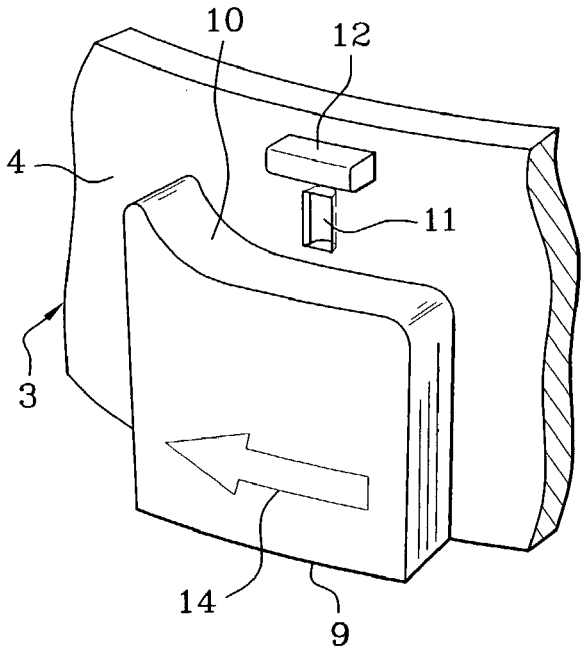

As shown in FIGS. 1 and 3A, the side wall 4 includes a plate member 9 (e.g., an extra thickness on the external surface of the side wall 4) which may extend angularly over a few degrees. The plate member 9 is located on a portion substantially opposite of the bore 8. The plate member 9 defines a guiding surface 10 facing in a direction opposite to a bottom 2 of the first portion 3. The guiding surface 10 includes a first surface portion and a second surface portion, each of which has a different surface profile from one another. For example, as shown in FIG. 3A, the first surface portion has a surface profile substantially perpendicular to the pivoting axis X, and the second surface portion has a surface profile gradually increasing in the direction of the opening 6 of the first portion 3.

Above the guiding surface 10, the side wall 4 forms a locking groove 11 (e.g., a snap-fastening groove). The locking groove 11 may extend in a direction parallel to the pivoting axis X. In a preferred embodiment, the locking groove may extend over a height of approximately 2 mm.

Proximate to the locking groove 11 (e.g., centered with respect to the groove 11), the side wall includes a guidance protrusion 12 (e.g., a flange) extending in a direction substantially perpendicular to both the bottom 2 and the pivoting axis X. In the illustrated embodiment, the guidance protrusion 12 may have a length of approximately 3 mm.

On the surface of the plate member 9, an indicator 14 (e.g., an arrow parallel to the bottom 3) for indicating a prescribed pivoting direction of the first portion 3 for opening of the case is provided.

The housing 7 is designed to receive an applicator 13 (e.g., a brush including a tuft of bristles arranged at an end of a handle) for applying the product contained in the case. The housing 7 may also include a mirror 15 bonded to the internal bottom surface of the housing 7.

The second portion 20 comprises a bottom 21 configured to substantially cover the entire opening 6 of the first portion 3 in a closed position. The bottom 21 includes the pin 22 located in the vicinity of its periphery and configured to engage inside the bore 8 of the first portion 3 by, e.g., snap-fastening mechanism.

On the side substantially opposite of the pin 22, the bottom 21 comprises a projection 23 extending towards the first portion 3. The projection 23 includes an edge defining a second guiding surface 24 that has a surface profile complementary to the surface profile of the first guiding surface 10, as shown in detail in FIG. 3B, so that the second guiding surface 24 may have an intimate contact with the first guiding surface 10 in the closed position. In this manner, the projection 23 is configured to engage with the plate member 9 of the first portion, so as to allow the pivotal movement of the second portion 20 only in one pivotal direction with respect to the first portion 3 for unlocking the first portion 3 and the second portion when the first portion 3 and the second portion 20 are in the closed position.

On its internal surface, the projection 23 comprises a guidance groove 25 configured to receive the guidance protrusion 12 of the first portion 3 in the closed position. For this purpose, the guidance groove 25 has an open mouth portion on one of the side edges 28 of the projection 23. Optionally, the mouth portion has a gradually widening width facing the guidance protrusion 12 so as to facilitate engagement between the guidance protrusion 12 and the guidance groove 25. The remaining portion of the guidance groove 25, other than the mouth portion, is defined by two edges aligned substantially parallel to each other.

Between the guidance groove 25 and the second guiding surface 24, the projection 23 comprises a locking protrusion 26 (e.g., a flange 26) on its internal surface. The locking protrusion 26 has a curved outer surface profile in a plane substantially parallel to the pivot axis X and is configured to be fastened in the groove 11 (e.g., snap-fastened), so as to enable reversible locking of the pivotal movement. For example, the locking protrusion 26 may be in the form of a grain of rice.

On the external surface of the projection 23, an indicator 27 (e.g., an arrow) may be provided for indicating a prescribed pivoting direction of the second portion 20 for opening of the case from the closed position.

The second portion 20 includes an annular skirt 29 extending from the upper surface of the bottom 21. The annular skirt 29 is separated by a distance from the peripheral edge of bottom 21. The annular skirt 29, in combination with the bottom 21, defines a second housing 30. The second housing 30 is designed to receive a product (e.g., a blush, a eye shadow, a rouge, etc.) to be applied. The product may be supplied in a container 31 (e.g., a cup) configured to contain the product. The container 31 may be bonded to or snap-fastened with the second housing 30.

The external surface of the annular skirt 29 comprises a screw thread 32 configured to cooperate with a corresponding screw thread 42 provided on the internal surface of a closure member 40 (e.g., a lid). The closure member is configured to substantially close the second housing 30 and, optionally, made of transparent or translucent material.

At least a portion of the case may be formed of a material comprising at least one of polypropylene, polystyrene acrylonitrile (SAN), and acrylobutadiene styrene (ABS). In an exemplary embodiment, the second portion 20 is made by molding polypropylene material, and the closure member 40 is made by molding polystyrene acrylonitrile (SAN).

Figure 4:
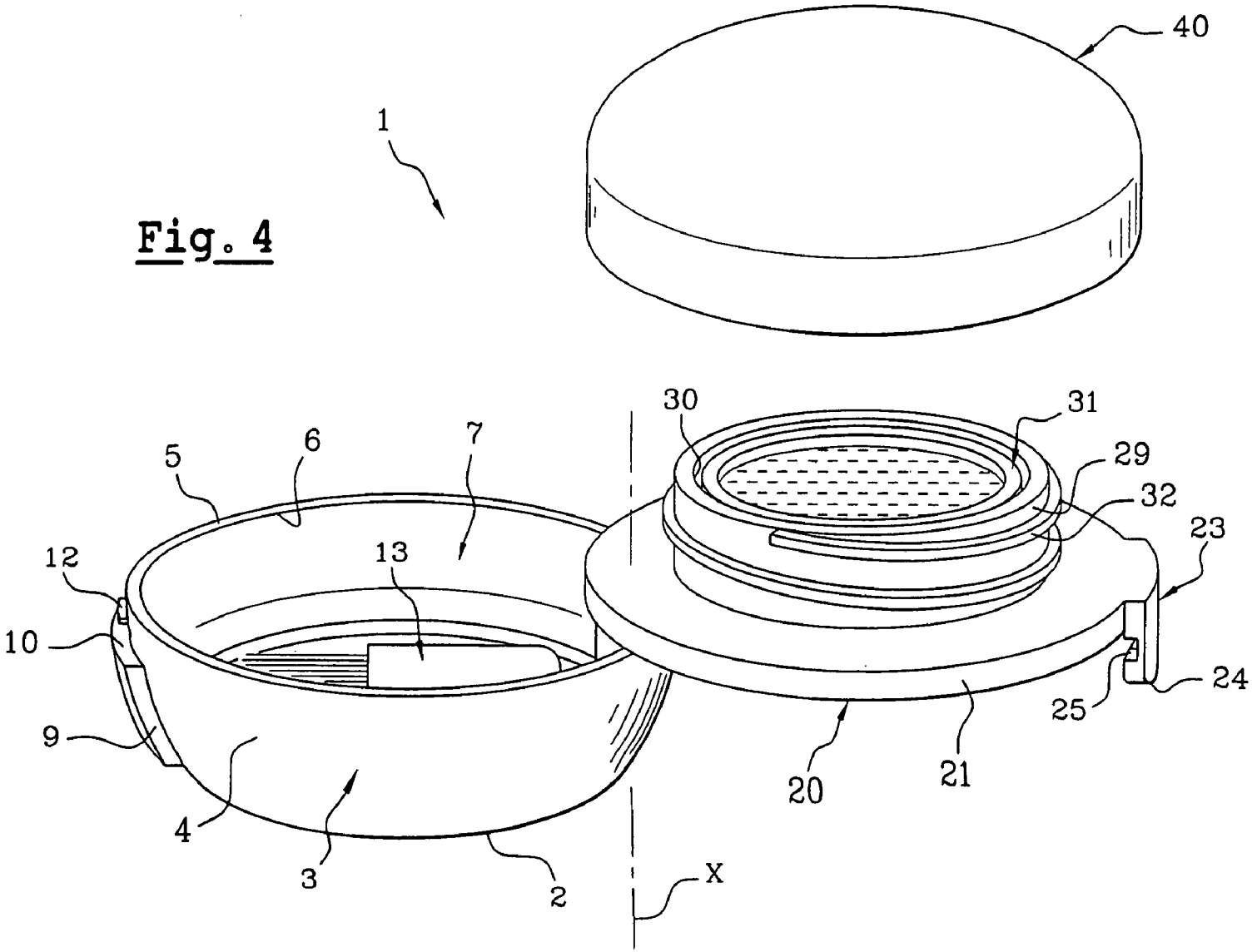
FIG. 4 is a schematic view of the case of FIG. 1 in an open position.
Figure 5A:
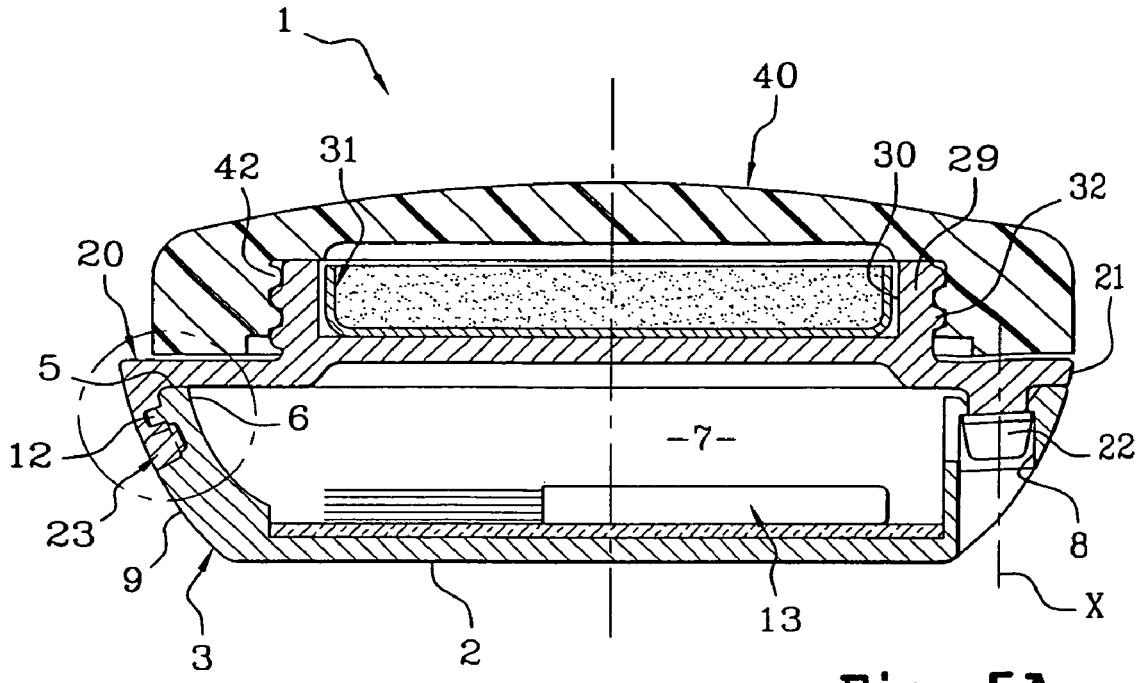
FIG. 5A is a sectional view of the case of FIG. 1 in a closed position.
Figure 5B:
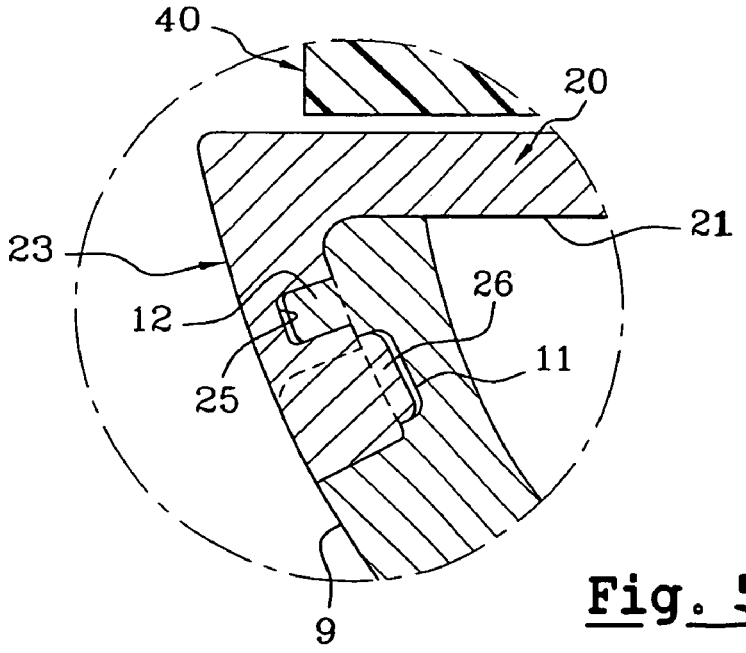
FIG. 5B is a detailed view of a portion of FIG. 5A.

FIGS. 1, 4, and 5A show how the case 1 is assembled. The assembly of the case 1 involves two major steps: first, the pin 22 is snap-fastened inside the bore 8, and, second, the closure member 40 is screwed onto the second portion 20. Optionally, an applicator 13 may be introduced into the housing 7.

In operation, to close the case 1 the second portion 20 may be rotated with respect to the first portion 3 about the pivot axis X so as to engage the guidance protrusion 12 of the first portion 3 with the guidance groove 25 of the second portion 20.

From this moment, the pivotal movement of the second portion 20 with respect to the first portion 3 is guided only in a direction perpendicular to the pivot axis X, so that the bottom 21 of the second portion 20 cannot deviate appreciably from the plane of opening 6 of the first portion 3.

The pivotal movement guided in that manner may be continued until the locking protrusion 26 of the second portion 20 engages (e.g., snap fastens) with the locking groove 11 of the first portion 3 to close the case. In this closed position, due to the structural configuration of the guidance protrusion 12 associated with the guidance groove 25, it becomes virtually impossible, unless a user applies an excessive force and damages the opening/closing mechanism of the case to an irreversible condition, to open the case by a movement other than the reverse, pivotal movement in the direction opposite of that used to close. The configuration of the opening/closing mechanism in the closed position of the case is shown in detail in FIG. 5B.

In an exemplary embodiment, the pin 22 and the bore 8 are disposed on a side of the case 1 substantially opposite (e.g., diametrically opposite) to the guidance groove 25 and the guidance protrusion 12.

For opening the case, substantially identical steps that are used to close the case may be taken, except that a relative pivotal movement of the second portion 20 with respect to the first portion 3 is conducted in the opposite direction to that of closing. (The pivotal movement in the same direction is substantially prevented by the presence of the complementary first and second guiding surfaces 10 and 24.)

To apply the product contained in the case, a user can open the first housing 6 of the first portion to take out an applicator 13. Then, the user can remove the closure member 40, take up the product with the applicator 13, and apply it in a conventional manner. Alternatively, the user can also choose to remove the closure member 40 before or without opening the first housing 6, directly having access to the second housing 30 containing the product.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. Case for packaging a product, comprising:

a first portion defining a first housing and an opening permitting access to the first housing, the opening facing in a first direction;

a second portion pivotally coupled to the first portion via a pivot member so as to permit pivoting of the second portion with respect to the first portion about a pivot axis substantially parallel to said first direction, the second portion being pivotally movable with respect to the first portion between a closed position covering the opening and an open position; and an opening/closing mechanism comprising:

a first projection extending from an outer surface of the first portion, and a second projection extending downwardly from an outer surface of the second portion, the second projection being configured to reversibly interlock with the first projection, a guidance arrangement configured so as to allow substantially only the pivotal movement of the second portion with respect to the first portion, the guidance arrangement being distinct from the pivot member, wherein at least part of the guidance arrangement is located on an outer lateral surface of the first portion, and a locking arrangement configured to reversibly lock the pivotal movement of the second portion with respect to the first portion in the closed position;

wherein the second portion defines a second housing;

wherein the case further comprises a closure member and a screw-fastening arrangement removably fastening the closure member to the second portion to close the second housing; and wherein the screw-fastening arrangement is configured such that a direction of rotation of the closure member, when unfastening the closure member from the second portion, is opposite to a direction in which the second portion is pivoted relative to the first portion to move from the closed position to the open position.

2. The case of claim 1, further comprising a product contained in the case, wherein the product comprises a cosmetic product.

3. The case of claim 1, wherein the case has at least one substantially circular outer cross-section, the pivot axis being substantially perpendicular to said cross-section.

4. The case of claim 1, wherein the second portion comprises a bottom configured to close substantially the entire opening of the first portion.

5. The case of claim 1, wherein the second portion comprises a bottom, and wherein the opening is defined by an edge of the first portion, all of the edge being below the bottom.

6. The case of claim 1, wherein the opening/closing mechanism is defined by a combination of the first and second portions.

7. The case of claim 1, wherein the guidance arrangement comprises:

a first guidance member on a side wall of the first portion; and a second guidance member associated with the second portion, wherein the first guidance member and the second guidance member are configured to cooperate with each other so as to guide pivoting of the second portion with respect to the first portion.

8. The case of claim 1, wherein the guidance arrangement comprises:

at least one guidance protrusion associated with one of the first portion and the second portion; and at least one guidance groove associated with the other of the first portion and the second portion, wherein the at least one guidance protrusion is configured to engage inside the at least one guidance groove so as to allow substantially only the pivotal movement of the second portion with respect to the first portion.

9. The case of claim 8, wherein the at least one guidance groove extends substantially perpendicular to the pivot axis.

10. The case of claim 8, wherein the at least one guidance groove is defined by two edges deviating from one another in the direction substantially parallel to the pivot axis.

11. The case of claim 8, wherein the at least one guidance groove has a mouth portion for receiving the at least one guidance protrusion, the mouth portion having a gradually widening width facing the at least one guidance protrusion so as to facilitate engagement between the at least one guidance protrusion and the at least one guidance groove.

12. The case of claim 8, wherein the at least one guidance protrusion is a flange elongated in the direction substantially perpendicular to the pivoting axis.

13. The case of claim 1, wherein the locking arrangement comprises a snap-fastening mechanism.

14. The case of claim 1, wherein the locking arrangement comprises:

a locking groove associated with one of the first portion and the second portion; and a locking protrusion associated with the other of the first portion and the second portion, wherein the locking protrusion is configured to engage with the locking groove so as to reversibly lock the pivotal movement of the second portion with respect to the first portion in the closed position.

15. The case of claim 14, wherein at least a portion of the locking protrusion has a curved outer surface profile in a plane substantially parallel to the pivot axis, so as to enable reversible locking of the pivotal movement.

16. The case of claim 14, wherein the locking protrusion is configured to substantially prevent movement between the first portion and the second portion in a direction substantially parallel to the pivot axis when the locking protrusion is engaged with the locking groove in the closed position.

17. The case of claim 14, wherein the locking groove extends in a direction substantially parallel to the pivot axis.

18. The case of claim 17, wherein the locking protrusion comprises a flange extending in the direction substantially parallel to the pivot axis and configured to lockingly engage with the locking groove.

19. The case of claim 1, wherein the opening/closing mechanism is configured to allow the pivotal movement of the second portion in a first pivotal direction with respect to the first portion so as to reversibly lock the first portion with respect to the second portion in the closed position, and the opening/closing mechanism is configured so that, when the first portion and the second portion are in the closed position, the pivotal movement is allowed only in a second pivotal direction substantially opposite to the first pivotal direction for unlocking the first portion and the second portion from the closed position.

20. The case of claim 1, wherein the first projection is a first part extending from the first portion and has a first guiding surface, at least a portion of the first guiding surface being non-perpendicular to the pivot axis; and wherein the second projection is a second part extending from the second portion and has a second guiding surface, at least a portion of the second guiding surface being non-perpendicular to the pivot axis, wherein the first guiding surface and the second guiding surface are configured to engage with each other in the closed position, such that when the first portion and the second portion are in the closed position, the opening/closing mechanism allows the pivotal movement of the second portion only in one pivotal direction with respect to the first portion for unlocking the first portion and the second portion from the closed position.

21. The case of claim 20, wherein at least one of the first part and the second part is integrally formed with a respective one of the first and second portions.

22. The case of claim 20, wherein at least one of the first part and the second part is a plate member extending from a side wall of a respective one of the first and second portions, wherein a side edge of the plate member defines a respective one of the first and second guiding surfaces.

23. The case of claim 20, wherein at least one of the first part and the second part is formed on an outer surface of a side wall of a respective one of the first and second portions.

24. The case of claim 20, wherein the opening/closing mechanism further comprises at least one indicator indicating a prescribed pivoting direction for opening and/or closing.

25. The case of claim 1, wherein the pivot member comprises:

a pin associated with one of the first portion and the second portion; and a bore defined by the other of the first portion and the second portion, wherein the pin is configured to be rotatably engaged in the bore.

26. The case of claim 25, wherein the pin is snap-fastened within the bore.

27. The case of claim 1, wherein at least a portion of the closure member is transparent or translucent.

28. The case of claim 1, wherein the second housing is defined by an annular skirt extending from a bottom of the second portion, the bottom being configured to cover at least a portion of the first housing.

29. The case of claim 28, wherein an outer surface of the annular skirt includes a threaded portion configured to engage with a threaded portion of the closure member.

30. The case of claim 1, wherein the first portion, the second portion, and the closure member are configured to allow access to the first housing without placing the closure member in a position permitting access to the second housing.

31. The case of claim 1, wherein the first portion, the second portion, and the closure member are configured to allow access to the second housing without the case being in the open position.

32. The case of claim 1, further comprising a product at least partially contained in at least one of the first housing and the second housing.

33. The case of claim 32, wherein the product comprises one of a blush, a eye shadow, and a rouge.

34. The case of claim 1, further comprising an applicator at least partially contained in at least one of the first housing and the second housing, the applicator being configured for application of the product.

35. The case of claim 1, further comprising a mirror.

36. The case of claim 1, wherein at least a portion of the case is formed of a material comprising at least one of polypropylene, polystyrene acrylonitrile, and acrylobutadiene styrene.

37. The case of claim 36, wherein at least a portion of the case is formed by molding the material.

38. The case of claim 1, wherein the first direction is substantially parallel to the pivot axis.

39. The case of claim 1, wherein the guidance arrangement lacks a semi-cylindrical chamber receiving part of the first portion.

40. Case for packaging a product, comprising:

a first portion defining a housing and an opening permitting access to the housing, the opening facing in a first direction;

a second portion pivotally coupled to the first portion via a pivot member so as to permit pivoting of the second portion with respect to the first portion about a pivot axis substantially parallel to said first direction, the second portion being pivotally movable with respect to the first portion between a closed position covering the opening and an open position; and an opening/closing mechanism comprising:

a first projection extending from an outer surface of the first portion, and a second projection extending downwardly from an outer surface of the second portion, the second projection being configured to reversibly interlock with the first projection, at least one guidance protrusion associated with one of the first portion and the second portion, and at least one guidance groove associated with the other of the first portion and the second portion, wherein the at least one guidance protrusion is configured to engage inside the at least one guidance groove so as to allow substantially only the pivotal movement of the second portion with respect to the first portion;

wherein the second portion comprises a bottom, and wherein the opening is defined by an edge of the first portion, all of the edge being below the bottom;

wherein the housing defined by the first portion is a first housing, and wherein the second portion defines a second housing;

wherein the case further comprises a closure member configured to substantially close the second housing; and wherein the first portion, the second portion, and the closure member are configured to allow access to the first housing without placing the closure member in a position permitting access to the second housing.

41. Case for packaging a product, comprising:

a first portion defining a first housing and an opening permitting access to the first housing, the opening facing in a first direction;

a second portion pivotally coupled to the first portion via a pivot member so as to permit pivoting of the second portion with respect to the first portion about a pivot axis substantially parallel to said first direction, the second portion being pivotally movable with respect to the first portion between a closed position covering the opening and an open position; and an opening/closing mechanism comprising:

a first part extending from an outer surface of the first portion and having a first guiding surface, part of the first guiding surface being substantially non-perpendicular to the pivot axis and part of the first guiding surface being substantially perpendicular to the pivot axis, and a second part extending downwardly from an outer surface of the second portion and having a second guiding surface, part of the second guiding surface being substantially non-perpendicular to the pivot axis and part of the second guiding surface being substantially perpendicular to the pivot axis, wherein the first guiding surface and the second guiding surface are configured to engage with each other in the closed position, such that when the first portion and the second portion are in the closed position, the opening/closing mechanism allows the pivotal movement of the second portion only in one pivotal direction with respect to the first portion for unlocking the first portion and the second portion from the closed position;

wherein the second part is configured to reversibly interlock with the first part;

wherein the second portion defines a second housing;

wherein the case further comprises a closure member and a screw-fastening arrangement removably fastening the closure member to the second portion to close the second housing; and wherein the screw-fastening arrangement is configured such that a direction of rotation of the closure member, when unfastening the closure member from the second portion, is opposite to a direction in which the second portion is pivoted relative to the first portion to move from the closed position to the open position.

42. The case of claim 41, further comprising a product contained in the case, wherein the product comprises a cosmetic product.

43. The case of claim 42, wherein the case has at least one substantially circular outer cross-section, the pivot axis being substantially perpendicular to said cross-section.

44. The case of claim 43, wherein the second portion comprises a bottom configured to close substantially the entire opening of the first portion.

45. The case of claim 43, wherein the second portion comprises a bottom, and wherein the opening is defined by an edge of the first portion, all of the edge being below the bottom.

46. The case of claim 43, wherein the opening/closing mechanism is defined by a combination of the first and second portions.

47. The case of claim 43, wherein the opening/closing mechanism further comprises a guidance arrangement configured so as to allow substantially only the pivotal movement of the second portion with respect to the first portion, the guidance arrangement being distinct from the pivot member.

48. The case of claim 47, wherein the guidance arrangement comprises:

at least one guidance protrusion associated with one of the first portion and the second portion; and at least one guidance groove associated with the other of the first portion and the second portion, wherein the at least one guidance protrusion is configured to engage inside the at least one guidance groove so as to allow substantially only the pivotal movement of the second portion with respect to the first portion.

49. The case of claim 48, wherein the at least one guidance groove extends substantially perpendicular to the pivot axis.

50. The case of claim 48, wherein the at least one guidance groove has a mouth portion for receiving the at least one guidance protrusion, the mouth portion having a gradually widening width facing the at least one guidance protrusion so as to facilitate engagement between the at least one guidance protrusion and the at least one guidance groove.

51. The case of claim 43, wherein the opening/closing mechanism further comprises a locking arrangement configured to reversibly lock the pivotal movement of the second portion with respect to the first portion in the closed position.

52. The case of claim 51, wherein the locking arrangement comprises a snap-fastening mechanism for reversibly locking the first portion with the second portion.

53. The case of claim 51, wherein the locking arrangement comprises:

a locking groove associated with one of the first portion and the second portion; and a locking protrusion associated with the other of the first portion and the second portion, wherein the locking protrusion is configured to engage with the locking groove so as to reversibly lock the pivotal movement of the second portion with respect to the first portion in the closed position.

54. The case of claim 53, wherein at least a portion of the locking protrusion has a curved outer surface profile in a plane substantially parallel to the pivot axis, so as to enable reversible locking of the pivotal movement.

55. The case of claim 53, wherein the locking protrusion is configured to substantially prevent movement between the first portion and the second portion in a direction substantially parallel to the pivot axis when the locking protrusion is engaged with the locking groove in the closed position.

56. The case of claim 55, wherein at least one of the first part and the second part is a plate member extending from a side wall of a respective one of the first and second portions, wherein a side edge of the plate member defines a respective one of the first and second guiding surfaces.

57. The case of claim 43, wherein at least one of the first part and the second part is integrally formed with a respective one of the first and second portions.

58. The case of claim 43, wherein the opening/closing mechanism further comprises at least one indicator indicating a prescribed pivoting direction for opening and/or closing.

* * * * *